US006345575B1

(12) United States Patent
Metrope

(10) Patent No.: US 6,345,575 B1
(45) Date of Patent: Feb. 12, 2002

(54) PIVOTABLE PRINTING-FORM CHANGING DEVICE AND METHOD FOR CHANGING PRINTING FORMS

(75) Inventor: Jacques Metrope, Laigneville (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/440,815

(22) Filed: Nov. 15, 1999

(30) Foreign Application Priority Data

Nov. 13, 1998 (DE) ..... 198 52 503

(51) Int. Cl.[7] ..... B41F 1/36
(52) U.S. Cl. ..... 101/415.1; 101/382.1
(58) Field of Search ..... 101/415.1, 382.1, 101/378, 383, DIG. 36

(56) References Cited

U.S. PATENT DOCUMENTS

| | | | | | |
|---|---|---|---|---|---|
| 4,936,212 A | * | 6/1990 | Moss | 101/DIG. 36 |
| 5,289,773 A | | 3/1994 | Saito et al. | 101/415.1 |
| 5,440,988 A | * | 8/1995 | Ito | 101/415.1 |
| 5,520,111 A | * | 5/1996 | Hirose | 101/415.1 |
| 5,555,811 A | * | 9/1996 | Ruckmann et al. | 101/415.1 |
| 5,595,120 A | * | 1/1997 | Metrope | 101/415.1 |
| 5,758,579 A | | 6/1998 | Marmin et al. | 101/486 |

FOREIGN PATENT DOCUMENTS

| | | | | |
|---|---|---|---|---|
| DE | 39 40 795 C2 | | 9/1991 | |
| DE | 0678382 A1 | | 10/1995 | |
| EP | 0 712 725 A2 | | 11/1994 | |
| EP | 0 667 237 A1 | | 8/1995 | |
| EP | 0 678 382 A1 | | 10/1995 | |
| EP | 0 678 383 A1 | | 10/1995 | |
| GB | 2279909 | * | 1/1995 | 101/415.1 |
| JP | 4-284252 | | 10/1992 | |

* cited by examiner

*Primary Examiner*—John S. Hilten
*Assistant Examiner*—Anthony H. Nguyen
(74) *Attorney, Agent, or Firm*—Herbert L. Lerner; Laurence A. Greenberg; Werner H. Stemer

(57) ABSTRACT

A device for changing printing forms on form cylinders of rotary printing machines, having a pivotable surface for guiding the printing forms to be changed, the printing forms being grippable at an underside thereof, includes a pivotable printing-form table to which a separately actuatable contact member is assigned, the contact member being throwable onto a surface of a printing form disposed on the printing-form table for positioning the printing form in any selective position, a method for changing printing forms, and a printing unit including the changing device.

13 Claims, 8 Drawing Sheets

PIVOTABLE PRINTING-FORM CHANGING DEVICE AND METHOD FOR CHANGING PRINTING FORMS

BACKGROUND OF THE INVENTION

1. Field of the Invention

The invention relates to a pivotable printing-form changing device for simply and rapidly changing printing forms to be fed to and removed from a cylinder, and to a method for changing printing forms.

The published European Patent Document EP 0 678 382 A1 discloses a device for replacing printing forms for rotary printing machines, especially in web-fed rotary printing machines for printing both sides of a web. Provided on these machines is at least one printing unit that accommodates at least one printing mechanism and a printing-form cylinder taking up the ends of a printing form wound around the surface of the cylinder. This cylinder has clamping devices within a gap and has assigned thereto a discharge device for the printing form that has been released from the plate cylinder and is to be changed, and a feed device for printing forms or plates which are to be newly affixed to the surface of the form cylinder. To the printing-form cylinder of a lower printing mechanism of a printing unit, there is assigned both a pivotable holder and feeder for new printing forms, and a pivotable holder for the printing forms to be removed from the form cylinder, the latter holder serving to pick up and release the printing forms in a downwardly hanging attitude.

The published European Patent Document EP 0 678 383 A1 is concerned with a device for exchanging printing plates in rotary printing machines. A printing unit of a rotary printing machine includes a printing-form or plate cylinder that takes up the two ends of a printing form or plate in a gap, the surface of the printing form or plate being wound around the cylinder, a device accommodating the printing form, that is located at the then time on the printing-form cylinder, after the printing form has been released by the clamping devices of the printing-form cylinder, as well as a device for feeding a new printing form to the printing-form cylinder. The latter device is distinguished by the fact that, at a slight distance from the outer surface of the printing-form cylinder, horizontally movable holding elements fix the leading edge of a printing form to be fed, until a remotely-controlled, engageable pivotable holder throws the leading edge of the printing form to be fed onto the outer surface of the printing-form cylinder.

In the two aforementioned constructions from the respective published German Patent Documents EP 678 383 A1 and EP 678 382 A1, the printing forms slide over suction cups during the clamping movement thereof on the form cylinder. This requires the rear surface of the printing forms which are to be drawn onto the cylinder to have a lubricating film provided thereon. Because this remains an activity that is largely performed manually, however, the lubricating film is not applied uniformly over the rear of the form. Furthermore, after a time, the lubricant is deposited or transferred onto the circumferential surface of the form cylinder and imparts sliding properties thereto which are undesirable and, moreover, necessitate frequent cleaning of the circumferential surface of the form cylinder. Furthermore, the suction cups required here for fixing the rear of the printing forms need an adequate vacuum to ensure the correct functioning of the suction cups. This embodiment calls for a large number of vacuum pumps and, therefore, requires a considerable outlay or expense to provide the vacuum.

The published European Patent Document EP 0 712 725 A2 is concerned with a rolling element for pressing a flexible printing form onto the form cylinder. The rolling element serves to press a flexible printing form onto the form cylinder of a printing unit of a rotary printing machine during a printing-form change. The rolling element includes a number of rollers which are arranged along the circumference of the form cylinder and can be set individually onto the latter. One or more first rollers can be set onto the form cylinder during the mounting of the printing form, and one or more second rollers can be set onto the form cylinder during the removal of the printing form, in the region of the printing form.

The published European Patent Document EP 0 667 237 A1 has disclosed an automated printing-form changing device. In this device for automatically changing printing forms in a printing machine, conceived for a sheet-fed printing machine, a printing form to be fed to the form cylinder is conveyed between driven transport rollers and backpressure rollers. The correspondingly driven transport rollers and the corresponding backpressure rollers are mounted so as to be movable in the axial direction of the form cylinder.

Finally, reference should be made to the published German Patent Document DE 39 40 795 C2 which discloses a method and a device for automatically feeding and removing a printing form, respectively. On a rotary printing machine, the start of the printing form and the end of the printing form are fixed on the form cylinder. The printing form is placed in a storage chamber in a printing form feed and removal device, respectively. The form cylinder is then rotated into a printing form feed position, and the printing form is fed to the clamping device of the form cylinder. In order to remove the printing form, the form cylinder is rotated into a form loosening position, and the clamping element for gripping the printing form end is opened. The form cylinder is then rotated backwards into the printing form feed position, and a clamping flap for gripping a printing form start is opened. The printing form is fed to the storage chamber of the printing form feed and removal device, respectively.

In the heretofore known devices of this general type, not just the leading edge alone, but both the leading edge and the trailing edge of a respectively new printing form are inserted into the cylinder gap. A separate pressure roller is required for this and, during the operation wherein the printing forms are clamped onto the form cylinder, a throw-on or retaining force is necessary, i.e., the delivery rollers, the pressure rollers, and so forth, have to be provided with controllable drives.

SUMMARY OF THE INVENTION

In view of the foregoing prior art, it is an object of the invention to provide a pivotable printing-form changing device configured for respectively feeding printing forms to a form cylinder and removing printing forms from a form cylinder while avoiding any requirement for additional backpressure, pressure or transport rollers.

With the foregoing and other objects in view, there is provided, in accordance with a first aspect of the invention, a device for changing printing forms on form cylinders of rotary printing machines, having a pivotable surface for guiding the printing forms to be changed, which are grippable at an underside thereof, comprising a pivotable printing-form table to which a separately actuatable contact member is assigned, the contact member being throwable onto a surface of a printing form disposed on the printing-form table for positioning the printing form in any selective position.

In accordance with another feature of the invention, the changing device includes a lever extension, the printing-form table and the lever extension being pivotable about a common pivot axis.

In accordance with a further feature of the invention, the changing device includes a separate actuating unit assigned to the printing-form table.

In accordance with an added feature of the invention, the changing device includes an independent actuating unit assigned to the separately actuatable contact member.

In accordance with an additional feature of the invention, the changing device includes separate actuating units, respectively, assigned to the printing-form table and to the contact member, respectively, at least one of the actuating units being constructed as a piston/cylinder unit.

In accordance with an alternative feature of the invention, the changing device includes separate actuating units, respectively, assigned to the printing-form table and to the contact member, respectively, at least one of the actuating units being constructed as an electromotive drive.

In accordance with yet another feature of the invention, the printing-form table is formed with an insert.

In accordance with yet a further feature of the invention, the insert has a flat surface.

In accordance with an alternative feature of the invention, the insert has a curved surface.

In accordance with yet an added feature of the invention, the contact member is a freely rotatable roller.

In accordance with an alternative feature of the invention, the contact member is a driven roller.

In accordance with yet an additional feature of the invention, the contact member is a roller having a yieldable surface.

In accordance with still another feature of the invention, the contact member is a roller subjectible to a pressure-medium loading.

In accordance with still a further feature of the invention, the insert is a component extending continuously over the width of the form cylinder.

In accordance with still an added feature of the invention, the insert comprises a plurality of components arranged at spaced intervals from one another over the width of the form cylinder.

In accordance with another aspect of the invention, there is provided a method for changing printing forms, which comprises exclusively feeding printing forms to a form cylinder.

In accordance with a further aspect of the invention, there is provided a method for changing printing forms, which comprises expressly removing printing forms from a form cylinder.

In accordance with a concomitant aspect of the invention, there is provided a printing unit of a rotary printing machine including a device for changing printing forms on form cylinders of the rotary printing machine, the changing device having a pivotable surface for guiding the printing forms to be changed, which are grippable at an underside thereof, comprising a pivotable printing-form table to which a separately actuatable contact member is assigned, the contact member being throwable onto a surface of a printing form disposed on the printing-form table for positioning the printing form in any selective position.

The changing device according to the invention is associated with a number of advantages. By a simple pivoting movement, the printing form can be thrown onto the outer surface of the form cylinder so that no further pressure rollers are needed for drawing the printing form onto the cylinder. Moreover, the application of a lubricating film to the underside of the printing form in order to seal off suction elements can be dispensed with completely, due to the fact that the printing form now adheres to the feed device only because of the frictional force and can be brought by the latter into any draw-on position or any position required for removal.

In a further refinement of the idea upon which the invention is based, the printing-form table and a lever extension, to which the contact member is connected, are movable about a common pivot axis. As a result, when there a printing form is located on the printing-form table, assurance is provided that the form is moved together with the pivotable printing-form table, so that the printing form can remain at all times in a defined attitude. Both the printing-form table and the separately actuatable contact member have an independent actuating unit, respectively, assigned thereto, it being possible for the throwing of the contact member onto the printing form to be varied as required. In addition to configuring the actuating unit as a piston/cylinder unit, the actuating units can also be formed as electromotive drives. The printing-form table is provided with an insert that is able to be incorporated into the table so that the latter remains flat; equally possible is a convex curvature of the insert, in order to stiffen the flat printing form by deformation. The contact member can be constructed, for example, as a freely rotatable roller that rotates freely on the lever extension and, when the printing form is being drawn onto the surface of the form cylinder, rolls on the surface of the printing form. Instead of being a freely rotatable roller, the contact member may be a driven roller. If the contact member is formed as a roller, the roller surface is preferably formed on a resilient, yieldable material; equally well, the contact member may be formed of a tube-like element loadable by or subjectible to a pressure medium loading.

The insert embedded or mortised in the pivotable printing-form table can be a continuous component extending over the width of the form cylinder. In addition to such a single-piece or unipartite construction, it is also possible for a number of insert components to be distributed over the width of the form cylinder, arranged at spaced intervals from one another. The device according to the invention can be used in such a way that it serves exclusively to feed printing forms. The device according to the invention can further be provided to remove the printing forms. For each printing unit, two of the devices according to the invention can be used for feeding the printing form, and for removing the latter from the form cylinder again; in this configuration, the device feeding the printing form can access a magazine with prepared printing forms, while the printing forms which have already been used can be deposited in a separate magazine by the further device according to the invention.

Other features which are considered as characteristic for the invention are set forth in the appended claims.

Although the invention is illustrated and described herein as embodied in a pivotable printing-form changing device, and a method for changing printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
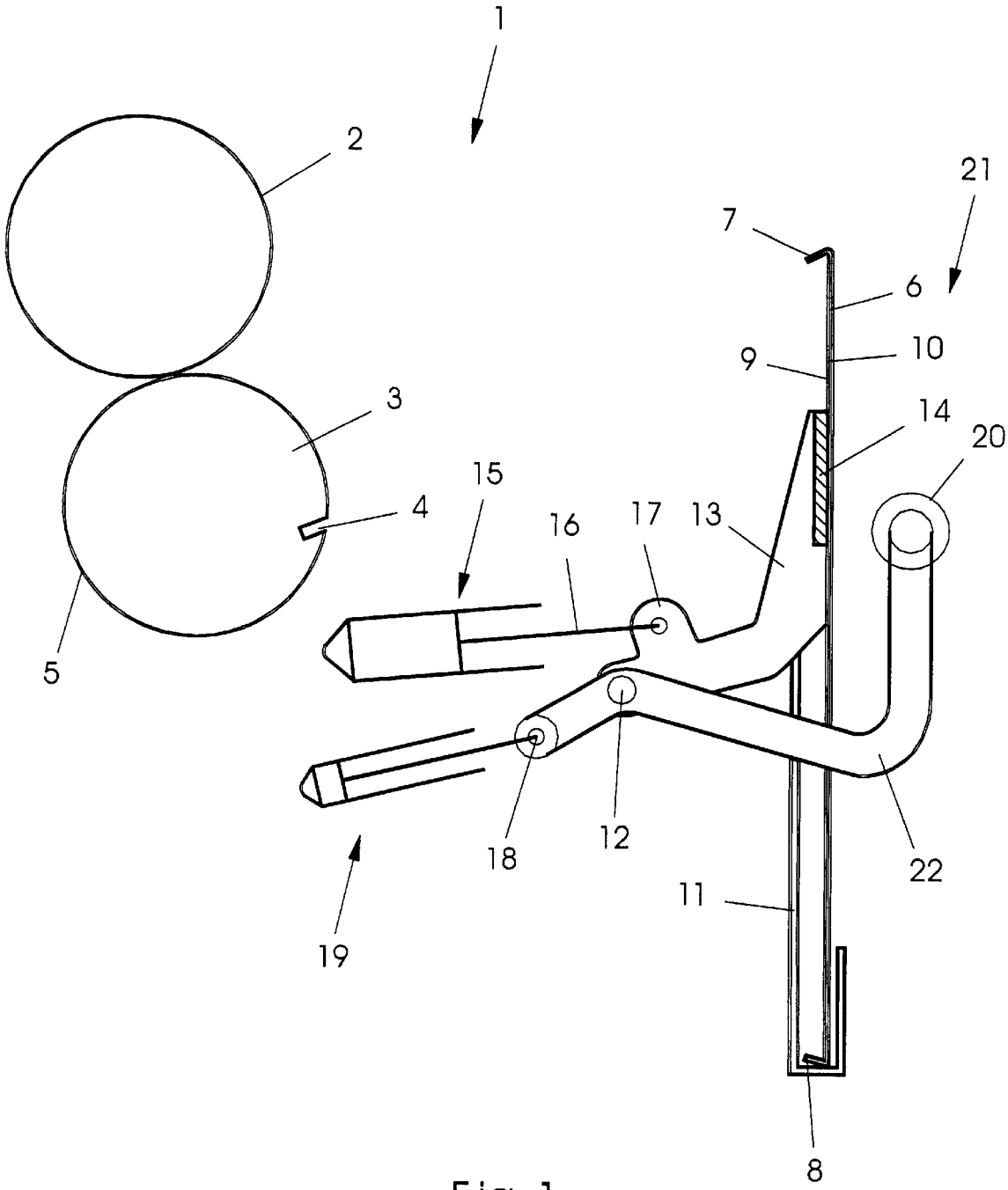
FIG. 1 is a diagrammatic side elevational view of a pivotable printing-form changing device according to the invention shown in a phase position thereof wherein a printing form can be moved into a removal magazine.

Referring now to the drawings and, first, particularly to FIG. 1 thereof, there is shown therein the pivotable printing-form changing device according to the invention in a phase position thereof wherein a printing form is being placed into a removal magazine.

A printing unit 1 of a rotary printing machine, such as a rotary offset printing machine, for example, includes a transfer cylinder 2 with which, for example, the underside of a material web can be printed. It is possible, for example, for a further printing unit 1, with which the upper side of the material web or of a sheet can be printed, to be arranged opposite the diagrammatically illustrated printing unit 1. The printing unit 1 further includes a form cylinder 3 having a cylinder gap 4 and an outer cylindrical surface 5. Accommodated in the cylinder gap 4 of the form cylinder 3 are clamping and tensioning or tautening devices, with which the ends 7 and 8 of a printing form 6 can be fixed to the outer surface 5 of the form cylinder 3. In FIG. 1, the printing form 6 is received in a magazine 11, wherein a plurality of printing forms can be stored.

In the operating-phase position shown in FIG. 1, a pivotable printing-form table 13 has been moved into a vertical attitude thereof, wherein an insert 14 provided in the printing-form table 13 engages the underside 9 of the printing form 6. The printing-form table 13 can be pivoted about a pivot axis 12 by a separate actuating unit 15, the actuating unit 15 in the illustration according to FIG. 1 being in the form of a piston/cylinder unit subjectible to a loading by a pressure medium, a piston rod 16 of the unit 15 being articulatedly connected to a lever extension 17 for moving or pivoting the printing-form table 13 about the pivot axis 12.

A lever extension 22 is likewise pivotable about the pivot axis 12 and has assigned thereto a separate actuating unit 19, independent of the aforementioned actuating unit 15, and in this case likewise formed as a piston/cylinder unit. The piston rod of the actuating unit 19 is articulatedly connected to the lever extension 22 at the articulation point 18, and moves the extension 22 likewise about the pivot axis 12. Secured to the lever extension 22 is a contact member 20 that is engageable with or throwable, by the actuation of the separate actuating unit 19, onto the surface 10 of the printing form 6 to be removed from the magazine 11. The contact member 20, as illustrated in FIG. 1, can be provided as a freely rotatable roller on the lever extension 22. The contact member 20 may also be a driven roller provided with a resilient or elastic and yieldable covering. Through the intermediary of the independent actuating unit 19, the contact member 20 can be pressed through the respective printing form 6 more-or-less intensively against the surface of the pivotable printing-form table 13, and can thus fix, relative to the latter, the printing form 6 that is being picked up and fed to the form cylinder 3. In the phase position shown in FIG. 1, the contact member 20 is held in a position disengaged or thrown-off from the surface 10 of the printing form 6.

Figure 2:
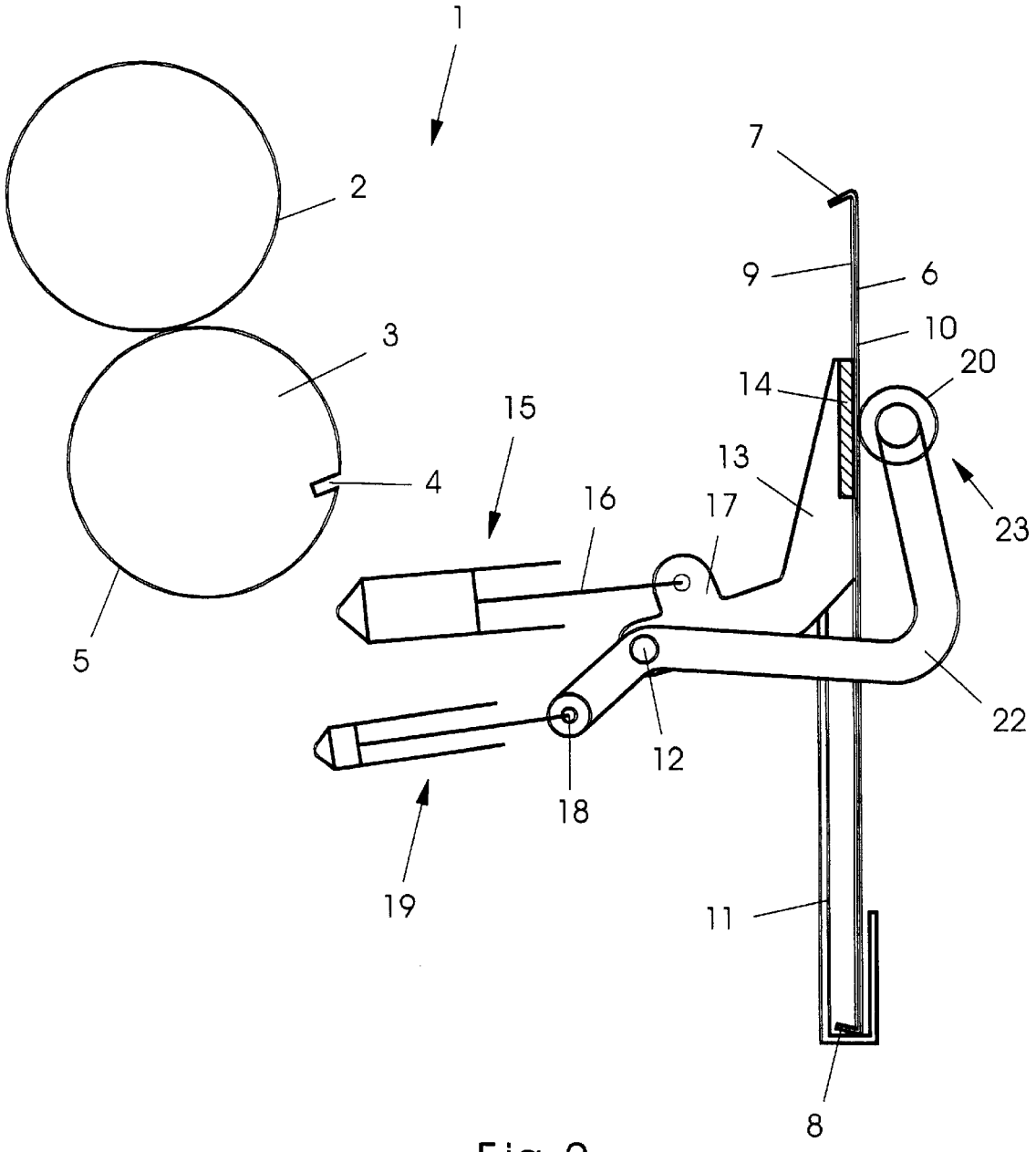
FIG. 2 is a view like that of FIG. 1 of the printing-form changing device in a different phase position thereof wherein a contact member thereof is shown lightly thrown onto the surface of a printing form.

FIG. 2 is a diagrammatic side elevational view of the printing-form changing device according to the invention, wherein the contact member 20 is engaged with or thrown onto the surface 10 of the printing form 6.

By applying pressure to the lower actuating unit 19, as viewed in the figures, the lever extension 22 that is pivotable about the pivot axis 12 is gently brought into engagement with or thrown onto the surface 10 of the printing form 6 and fixes the printing form 6 on the printing-form table 13. The thrown-on or engaged phase position is identified by reference numeral 23. If only one printing form 6 is contained in the magazine 11, the latter can be moved downwardly away from the single printing form 6 and, for example, in this way, releases a printing form 6.

In the phase condition represented in FIG. 2, the printing form 6 has been fixed by throwing the contact member 20 onto the printing form 6, which rests on an insert 14 embedded in the printing-form table 13. This insert 14 can be embedded in the printing-form table 13 in a construction, can be essentially flat or can have a curved shape or can be formed of a plurality of individual components arranged alongside and spaced from one another.

Figure 3:
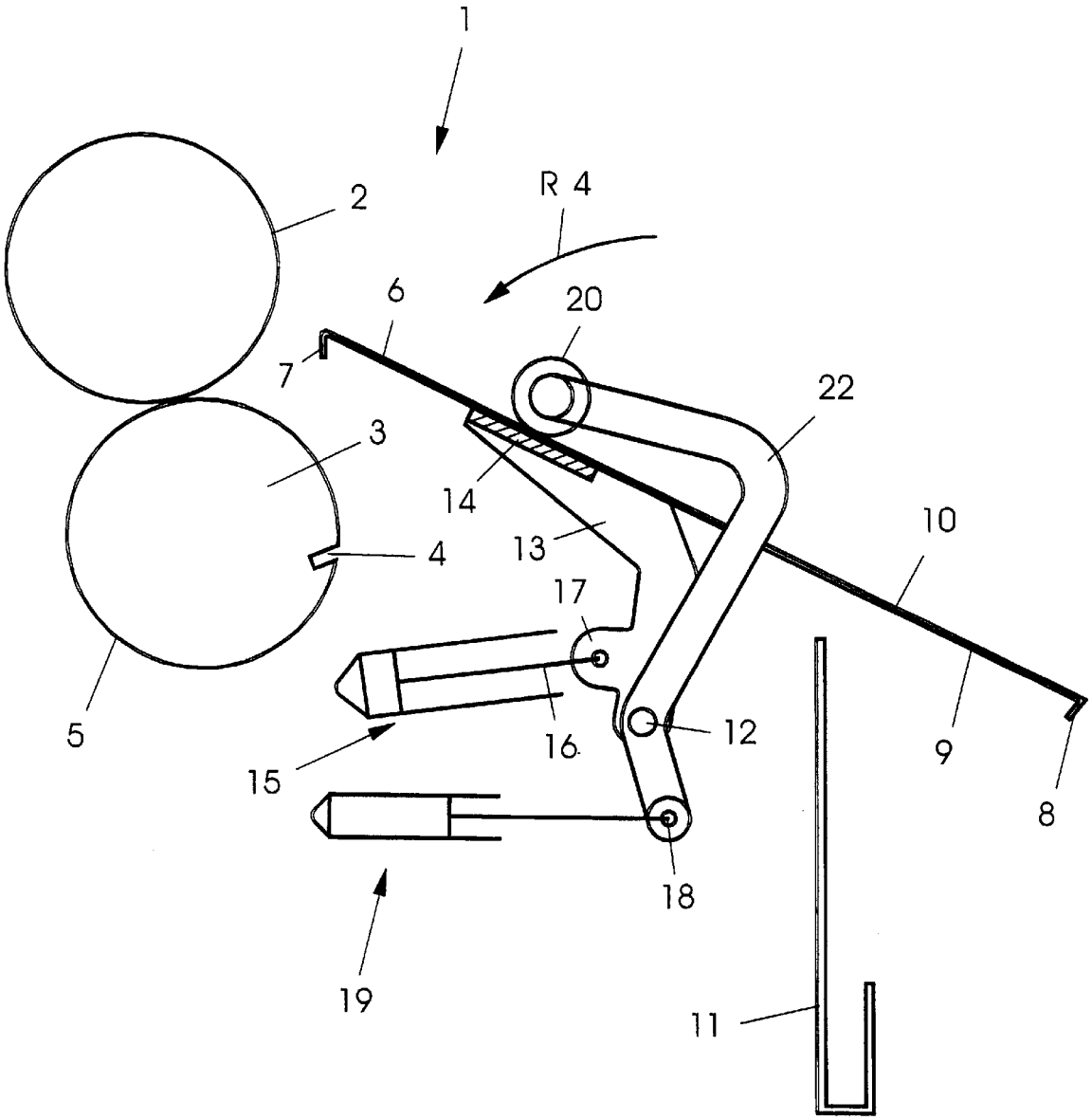
FIG. 3 is a view like those of FIGS. 1 and 2 showing the printing-form changing device in a further phase position wherein a printing form is being transported up to the form cylinder.

FIG. 3 is a diagrammatic side elevational view of the printing-form changing device according to the invention, wherein a printing form 6 is shown being transported up to the form cylinder 3.

After the printing form 6 has been fixed to the pivotable printing-form table 13, the latter is pivotable about the pivot axis 12 by an upper actuating unit 15, as viewed in FIG. 3, due to which the printing form 6 is pivoted, as indicated by the curved arrow R4, into a plane that is slightly inclined to the horizontal. While the piston is being retracted into the actuating unit 15, the contact member 20 connected to the lever extension 22 is kept in thrown-on or engaged condition with the surface 10 of the printing form 6 by the lower actuating unit 19, as viewed in the figure, due to which the printing form 6 is not able to move relative to the printing-form table 13. The movement of the two components, namely the printing-form table 13 and the lever extension 22, which are pivotable about the pivot axis 12, is coordinated by the two actuating units 15 and 19 so that, during the common pivoting movement of the contact member 20 and the printing-form table 13 with the printing form 6 resting on the latter, no relative movements result therebetween, and the printing form 6 remains in a defined position on the printing-form table 13.

Figure 4:
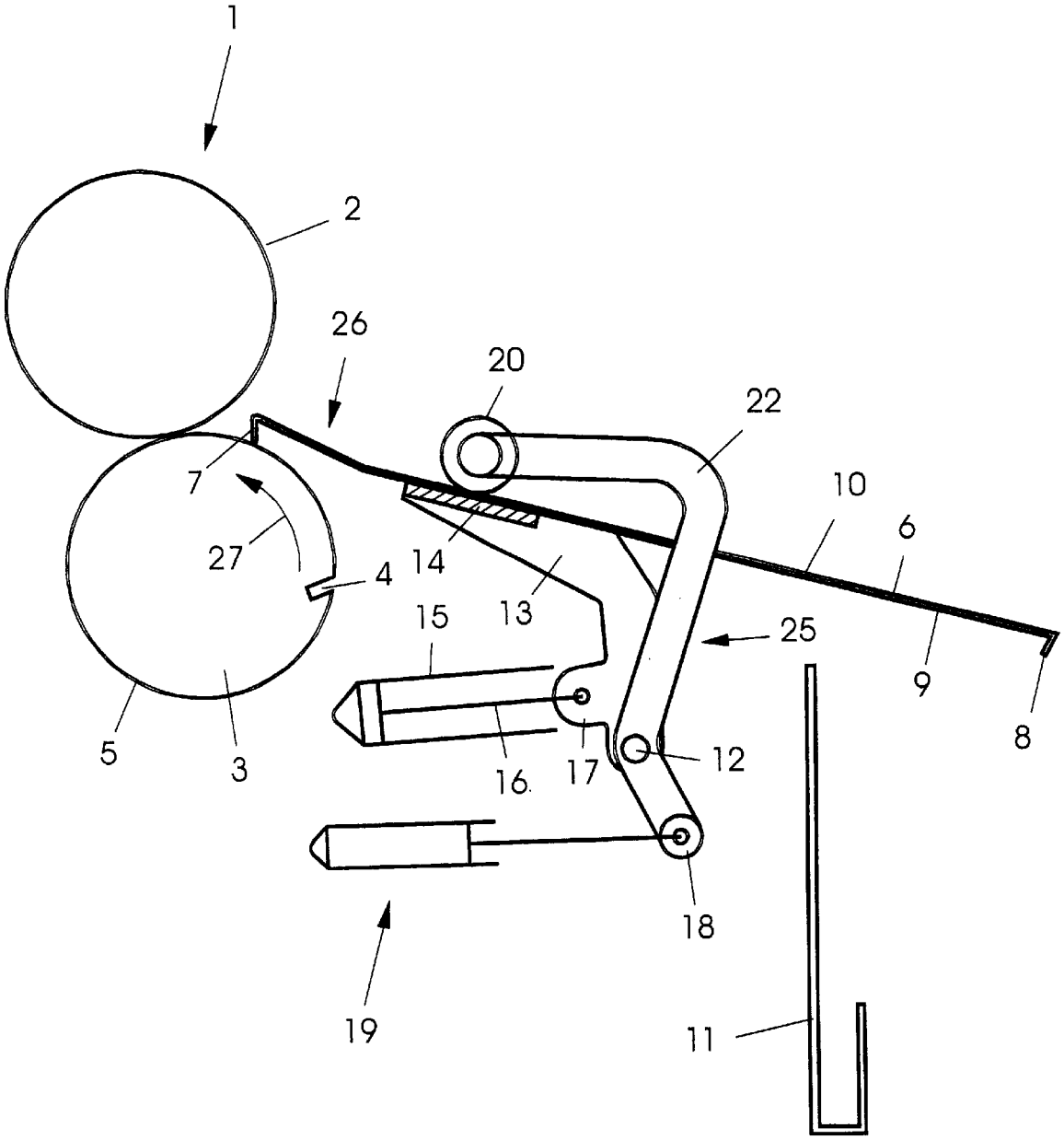
FIG. 4 is a view like those of FIGS. 1 to 3 showing the changing device in another phase position wherein the changing device has thrown a printing form onto the form cylinder.

FIG. 4 is a diagrammatic side elevational view of the printing-form changing device according to the invention in a phase position wherein a printing form 6 is engaged with or has been thrown onto the form cylinder 3 by the device according to the invention.

The printing form 6 is thrown, with a region thereof extending forward over the printing-form table 13, onto the outer surface 5 of the form cylinder 3. If the form cylinder 3 is rotated slowly in the drawing-on direction represented by the curved arrow 27, the leading edge 7 of the printing form 6 will snap into the cylinder gap 4 formed in the form cylinder 3 and, as the form cylinder 3 rotates farther in the direction of the arrow 27, the printing form 6 will be drawn further onto the outer surface 5 of the cylinder 3. Reference numeral identifies the pivoting position of the printing-form table 13 and the lever extension 22, which have both been pivoted in a manner that no relative movements have been able to occur between the contact member 20 and the surface 10 of the printing form 6.

Figure 5:
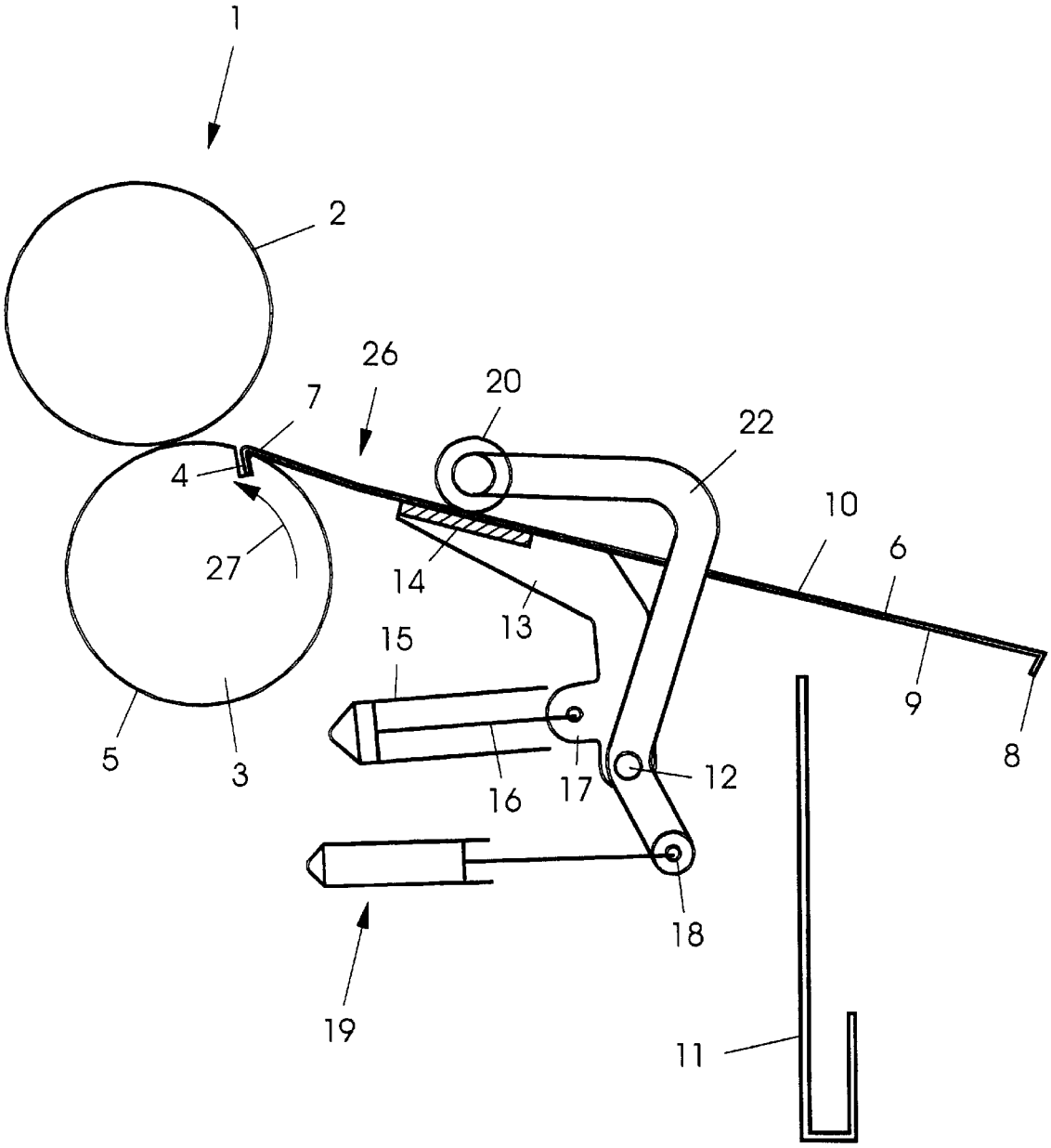
FIG. 5 is a view like those of FIGS. 1 to 4 showing the changing device in an additional phase position wherein the leading edge of a printing form is hooked into a cylinder gap formed in the form cylinder.

FIG. 5 illustrates the action wherein the leading edge of the printing form 6 snaps into the cylinder gap 4 formed in the form cylinder 3.

The action wherein the leading edge 7 of the printing form 6 snaps into the cylinder gap 4 causes the leading edge 7 of the printing form to come to rest on one of the side walls defining the cylinder gap 4. The thrown-on or engaged position 26 of the leading region of the printing form 6 is straightened out somewhat; a slight deformation of the region is nevertheless provided for the start of the drawing-on phase; as the form cylinder 3 rotates further in the direction of the arrow 27, the printing form 6 is drawn onto the circumferential surface 5 of the form cylinder 3 During the drawing-on operation, the contact member 20 remaining thrown onto or in engagement with the surface 10 of the printing form 6. In the case wherein the contact member 20 is a roller, as illustrated in FIG. 5, the roller 20 runs on the surface 10 of the printing form 6 while the latter is gradually run onto the outer surface 5 of the form cylinder 3 and, little-by-little, leaves the printing-form table 13.

Figure 6:
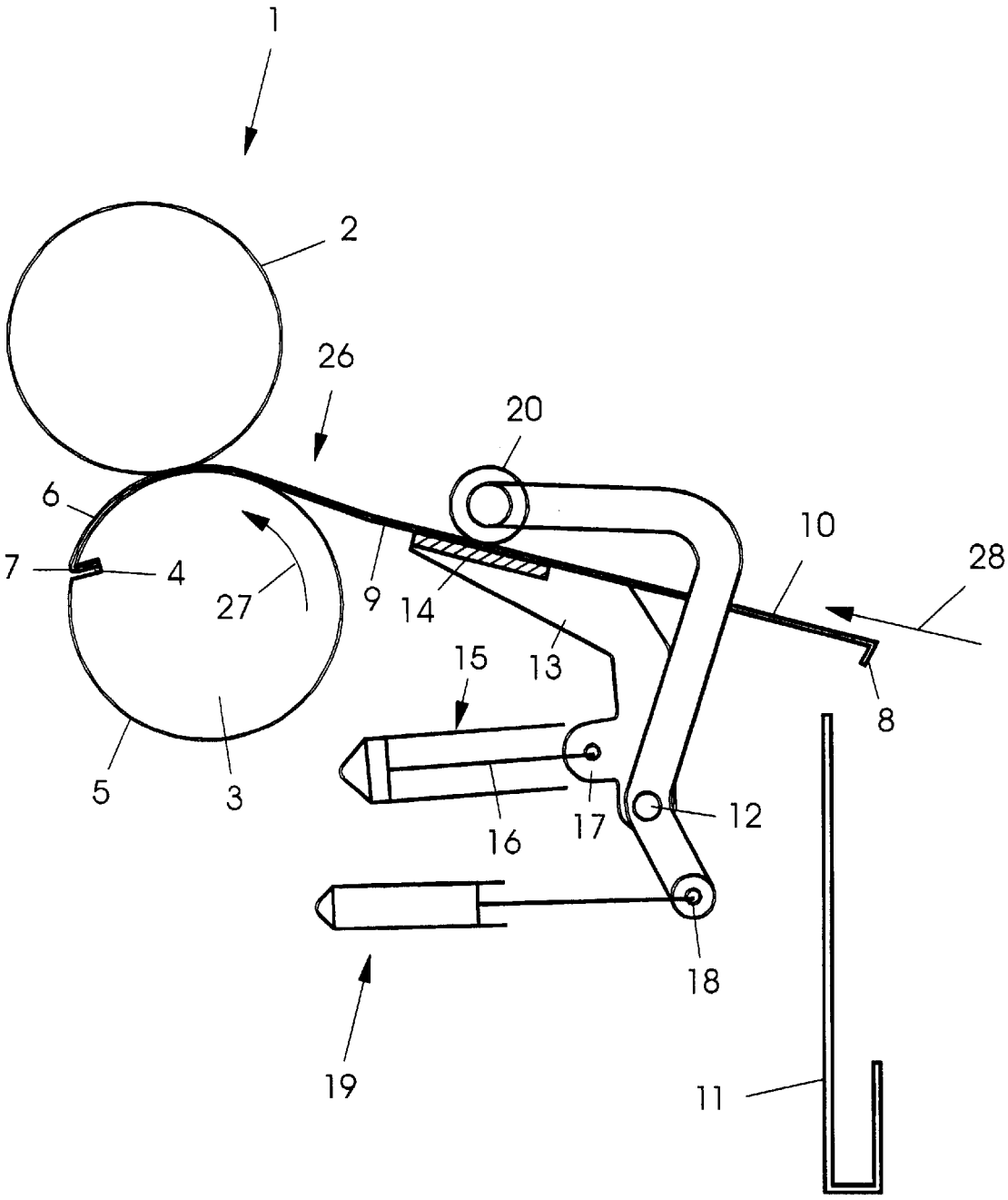
FIG. 6 is a view like those of FIGS. 1 to 5, showing the changing device in yet another phase position wherein a printing form has been drawn onto the outer surface of the form cylinder.

FIG. 6 illustrates the operation wherein the printing form 6 is drawn onto the circumference of the form cylinder 3.

The drawing of the printing form 6 onto the form cylinder 3 takes place in the direction of the arrow 28 which represents the direction of movement of the printing form 6 due to the rotation of the form cylinder 3 in the direction of the curved arrow 27. Neither the printing-form table 13 nor the contact members 20 have changed the positions thereof relative to one another; the printing form 6 is thrown onto or brought into engagement with the circumferential surface 5 of the form cylinder 3 by the contact member 20. The printing form 6 runs with the underside 9 thereof onto the outer surface 5 of the form cylinder 3 and snugly engages the circumferential surface 5 of the latter, and, in this manner, leaves the pivotable printing-form table 13. The actuating units 15 and 19, formed, for example, as pneumatic cylinders, continue to have pressure applied thereto, and hold both the pivotable printing-form table 13 and the lever extension 22, together with the contact member 20, in the respective positions thereof relative to one another.

Figure 7:
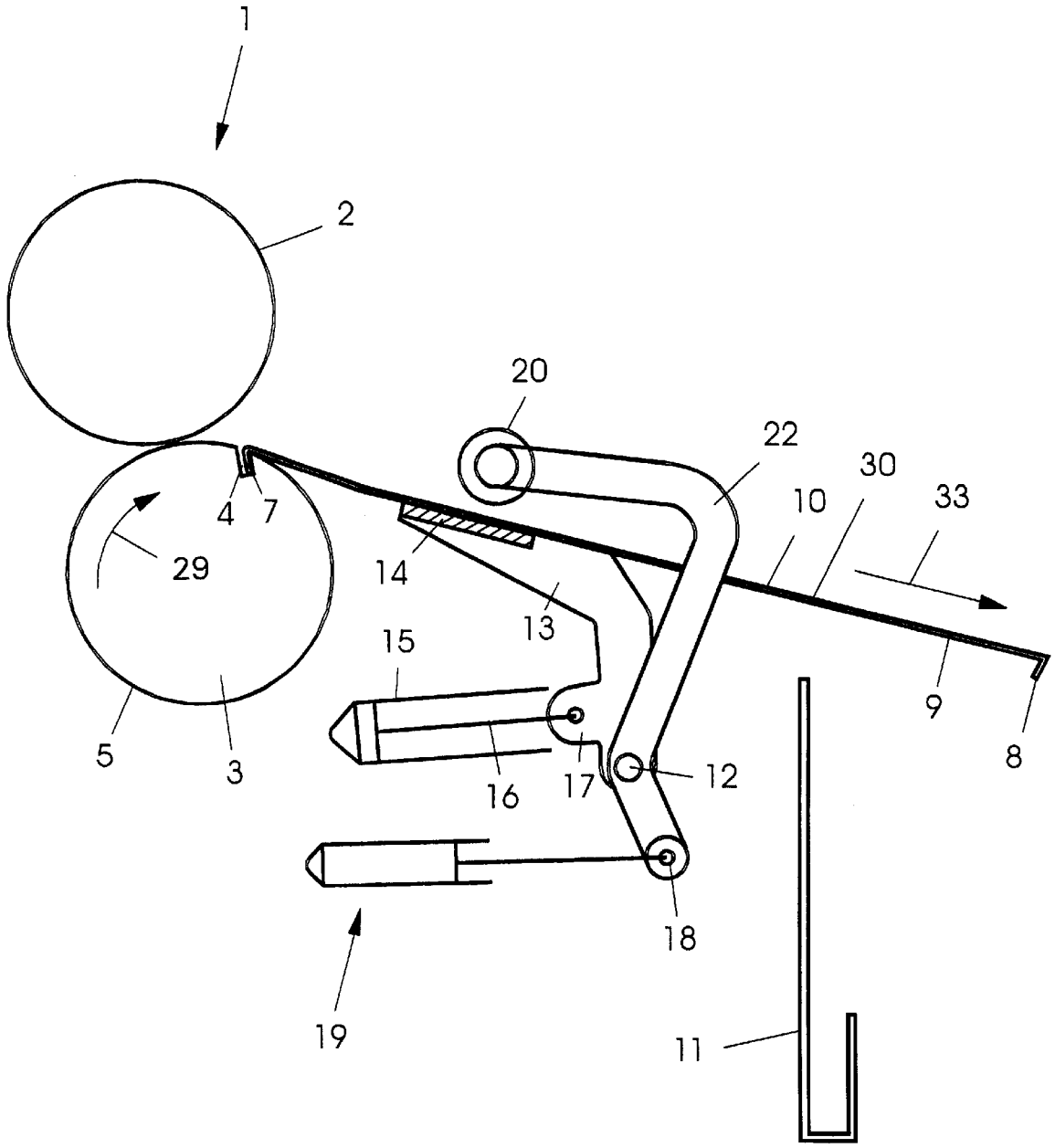
FIG. 7 is a view like those of FIGS. 1 to 6, showing the pivotable changing device according to the invention in yet a further phase position wherein a printing form to be removed from the form cylinder is being pushed onto the pivotable changing device according to the invention.

FIG. 7 illustrates the action of pushing onto a printing-form table 13 a printing form that is to be removed from the form cylinder 3.

The trailing edge 8 of the printing form 6, released by the clamping devices arranged in the cylinder gap 4, is loosened or detached from the circumference of the form cylinder 3 as the latter rotates in the direction of the arrow 29, and is pushed onto the printing-form table 13 in a runoff or output direction represented by the arrow 33. In this operating phase, the contact member 20 is thrown off from the surface 10 of the printing form 6 and does not actually engage the surface 10. As soon as the printing form 6 covers the printing-form table 13 to a sufficient extent, the actuating unit 19 is activated, and the lever extension 22, together with the contact member 20 connected thereto, is pivoted and thrown onto the surface 10 of the printing form 6. The printing form 6 is then no longer movable relative to the printing-form table 13.

Figure 8:
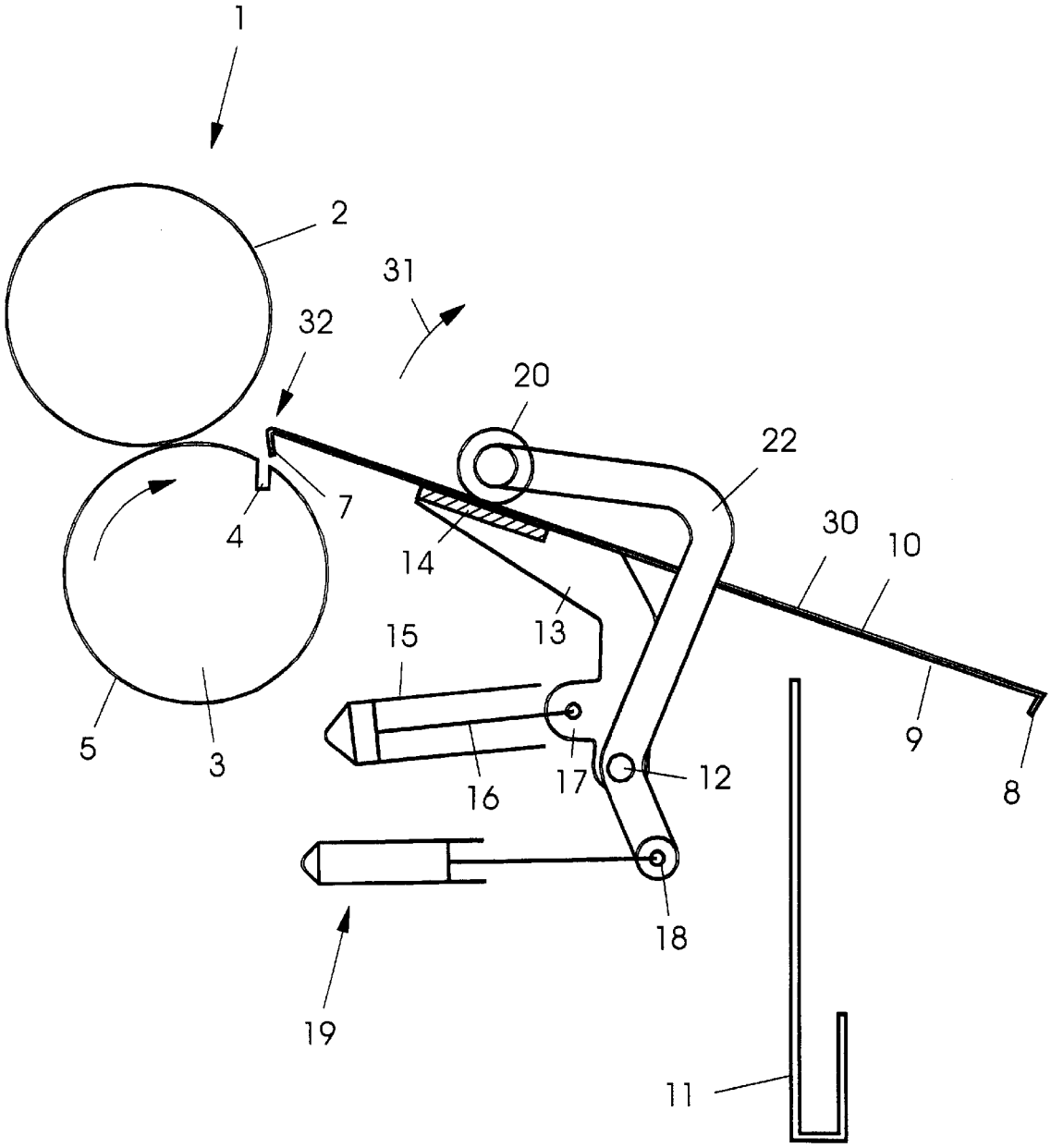
FIG. 8 is a view like those of FIGS. 1 to 7, showing the printing-form changing device according to the invention, in a concomitant phase position wherein a leading edge of a printing form is being lifted out of the cylinder gap formed in the form cylinder.

FIG. 8 illustrates the lifting of the leading edge of a printing form 6 out of the cylinder gap 4 formed in the form cylinder 3.

Due to the activation of the actuating units 15 and 19, the printing-form table 13, together with the lever extension 22, is moved about the pivot axis 12 as represented by the curved arrow 31 which reproduces the lifting movement. Because the printing form 6 is fixed on the printing-form table 13 by the contact member 20, relative movement between the printing form 6 and the printing-form table 13 is avoided by suitably loading the two actuating units 15 and 19, respectively, so that the lever extension 22 and printing-form table 13 are moved parallel to one another, and no relative movements between the contact member 20 and the printing form 6 occur. As soon as the printing form 30, which is to be removed, has been removed from the form cylinder 3, the printing form 30 can be fed to the magazine 11 again. This process is not shown in FIG. 8.

It is entirely possible for the printing unit 1 also to have assigned thereto two printing form changing devices according to the invention, one changing device for the printing forms 6 to be newly mounted, together with the associated magazine 11, and another changing device exclusively for the printing forms 30 to be removed from the form cylinder 3, together with the associated magazine 11. A soiling of new printing forms by older, previously used printing forms can be prevented by separating the printing forms from one another, and the new printing forms 6 can be fed to the form cylinder 3 without scratches or deposits of ink.

Besides the magazines 11 which are diagrammatically illustrated in the figures, and from which the printing forms 6, 30, respectively, are removable upwardly, it is also possible to provide magazines which are pivotable together with the printing-form table 13 and which, if necessary or desirable, can be provided with a movable flap which pivots away as soon as the actuating units 15 and 19 have been activated, and the printing form 6, 30, respectively, has been gripped and released, respectively, by the printing-form table 13 and the contact member 20.

I claim:

1. A device for changing a printing form on a form cylinder of a rotary printing machine, the device comprising:

a pivot axis;

a printing-form table being pivotable about said pivot axis, the printing-form table guiding and releasably contacting the printing form;

a separately actuatable contact member including a roller releasably contacting the printing form disposed on the printing-form table and a first actuating unit assigned to the printing-form table, said first actuating unit pivoting said printing form table with the printing form contacted by said separately actuatable contact member relative to the form cylinder.

2. The changing device according to claim 1, including a lever extension, said printing-form table and said lever extension being pivotable about a common pivot axis.

3. The changing device according to claim 1, wherein said roller is subjectible to a pressure-medium loading.

4. The changing device according to claim 1, including an independent actuating unit assigned to said separately actuatable contact member.

5. The changing device according to claim 4, wherein said actuating units are separate and at least one of said actuating units is constructed as a piston/cylinder unit.

6. The changing device according to claim 4, wherein said actuating units are separate and at least one of said actuating units is constructed as an electromotive drive.

7. The changing device according to claim 1, wherein said printing-form table is formed with an insert.

8. The changing device according to claim 7, wherein said insert has a flat surface.

9. The changing device according to claim 7, wherein said insert is a component extending continuously over the width of the form cylinder.

10. The changing device according to claim 1, wherein said separately actuatable contact member is a freely rotatable roller.

11. The changing device according to claim 1, wherein said roller has a yieldable surface.

12. In a printing unit of a rotary printing machine including a changeable print form having a grippable underside, a form cylinder having a surface for guiding the printing form, the improvement comprising:

a pivot axis;

a printing-form table being pivotable about said pivot axis, the printing-form table guiding and releasably contacting the printing form;

a separately actuatable contact member including a roller releasably contacting the printing form disposed on the printing-form table and a first actuating unit assigned to the printing-form table, said first actuating unit pivoting the printing form table with the printing form contacted by said separately actuatable contact member relative to the form cylinder.

13. A rotary printing unit, comprising:

a form cylinder for holding a printing form;

a pivot axis;

a printing-form table being pivotable about said pivot axis, said printing-form table guiding and releasably contacting the printing form;

a separately actuatable contact member including a roller releasably contacting the printing form disposed on said printing-form table and an actuating unit associated with the printing-form table, said actuating unit pivoting said printing form table with the printing form contacted by said separately actuatable contact member relative to said form cylinder.

* * * * *